United States Patent [19]

Missioux

[11] 4,203,579

[45] May 20, 1980

[54] INSTALLATION FOR TEMPERING LONG CYLINDRICAL PIECES IN FORM AND IN THIN LAYER

[76] Inventor: Jean L. Missioux, 55 Boulevard Gambetta, 95110 Sannois, France

[21] Appl. No.: 2,235

[22] Filed: Jan. 9, 1979

Related U.S. Application Data

[63] Continuation-in-part of Ser. No. 812,361, Jul. 1, 1977, abandoned.

[51] Int. Cl.[2] ..... C21D 9/30

[52] U.S. Cl. ..... 266/117; 266/119; 266/121

[58] Field of Search ..... 266/117, 119, 121

[56] References Cited

U.S. PATENT DOCUMENTS 4,057,230 11/1977 Hays et al. ..... 266/117

*Primary Examiner*—R. Dean

*Attorney, Agent, or Firm*—Kerkam, Stowell, Kondracki & Clarke

[57] ABSTRACT

A tempering unit for tempering shaped forms in thin layer has an interchangeable central unit provided with grippers for the workpiece before tempering made up of an assembly of bearing fingers supporting the workpiece and assembly of bearing fingers mounted on closing jacks which bear against the upper part of the workpiece with the supporting fingers preadjusted in height. The structure is particularly adaptable to tempering long cylindrical pieces.

6 Claims, 5 Drawing Figures

INSTALLATION FOR TEMPERING LONG CYLINDRICAL PIECES IN FORM AND IN THIN LAYER

REFERENCE TO RELATED APPLICATION

This application is a continuation-in-part of my application Ser. No. 812,361 filed July 1, 1977, now abandoned.

BACKGROUND OF THE INVENTION

The present invention relates to a tempering installation for shaped workpieces in a thin layer particularly for long cylindrical pieces such as drive shafts and cam shafts for automobile engines.

Tempering systems for workpieces leaving a furnace usually fit in two categories; tempering in bulk in which apparatus for lifting the pieces from the cooler are provided and tempering of ordered workpieces which is the only way for tempering long workpieces. Other than tempering arrangements usually provided for the automatic manufacture of workpieces of variable dimension such as helicoidal springs, tempering structures are known for long workpieces in which the pieces are arranged on supports descending in the bath or reversed on a false plateau at the transfer conveyor. A tempering installation is also known for long pieces which utilizes a furnace employing an endless carrying table above the end of which is disposed a bin extended by a horizontal channel provided with an opening for the pieces falling in a bath on a lifting table. A tempering process is also known for long pieces associated with heating apparatus utilizing induction which consist in mounting in parallel an induction assembly and a tempering assembly in such a way that a passage from one to the other occurs rapidly and automatically.

All of these known structures have certain advantages but there are also inconveniences which essentially are that they are designed and operated for a predetermined workpiece and the replacement of a workpiece to be treated by another of different size or configuration necessitates an important modification of the support of the workpiece in the tempering bath and of the manipulation structure for the workpieces. Another inconvenience of known structures and systems relates to the tempering method. It is known the the process referred to as tempering in a thin layer has advantages on the plan of duration of tempering; of the quality of the tempered product; and of the cost of the operation. Known systems do not assure tempering in thin layer of long pieces under optimum conditions. The present invention provides a solution to these problems and allows for the interchangeability of the workpieces to be tempered because the central tempering unit is movable and can receive a tempering mounting preregulated as a function of the workpieces that it receives. The present invention also provides for tempering in a thin layer of the workpieces in that it utilizes supporting mechanisms and particular means which limit the thickness of the layer of tempering liquid to an appropriate value.

BRIEF SUMMARY OF THE INVENTION

In accordance with the present invention, the central tempering unit is interchangeable and includes means for gripping the workpiece before tempering including an assembly of fixed supporting fingers on which the workpiece rests an assembly of bearing fingers mounted on closing jacks which bear on the upper part of the workpiece with the support fingers being preadjusted in height.

In accordance with another characteristic of the present invention interchangeable elements adapted to the fixed and movable supports of the fingers for supporting the workpiece to be treated limit the thickness of the layer of tempering liquid.

BRIEF DESCRIPTION OF THE DRAWINGS

Other characteristics and advantages of the present invention will appear from the following description of a preferred but non-limiting embodiment thereof with reference to the accompanying drawings in which.

DESCRIPTION OF THE PREFERRED EMBODIMENT

Figure 1:
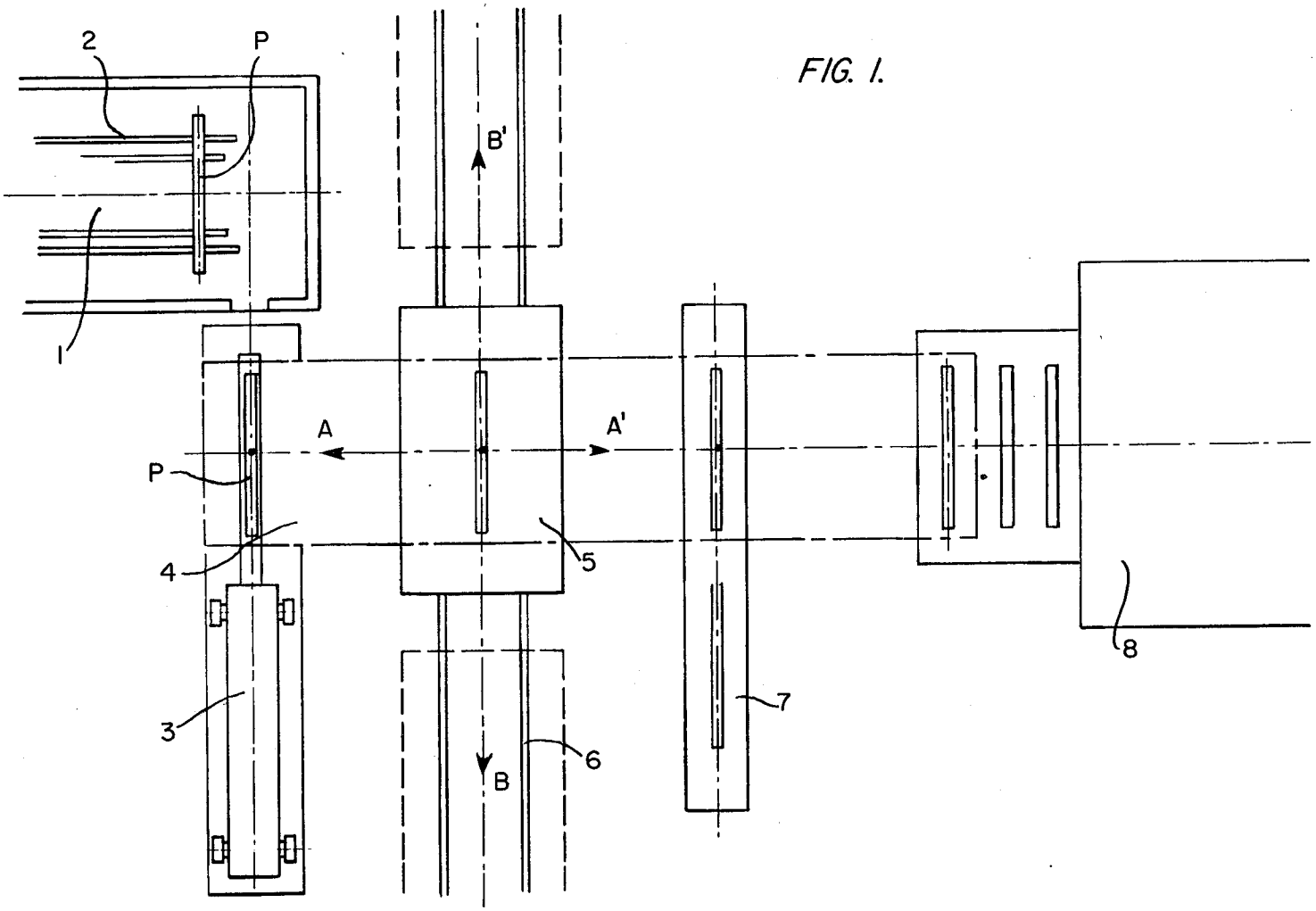
FIG. 1 is a schematic planned view of a preferred embodiment of the assembly of the installation.

The installation shown schematically in FIG. 1 essentially includes an austenization furnace 1 provided with longitudinal supports 2 for the advance in "step pelerin" of the long workpiece to be treated indicated by reference P. A movable carriage 3 with telescopic arm or analogous system lifts the workpiece P from the austenization furnace to dispose it upstream of a transfer conveyor 4 provided with gripping members which are not shown. The central tempering unit 5 is movable on transverse rails 6 and can thus be disengaged from one part or the other of conveyors 4. It is thus removable and can be replaced by a known tempering unit such as utilized in the manufacture of automobile springs. An evacuation system, not shown, associated with the central tempering unit includes a storage conveyor 7 mounted transversely of the transfer conveyor 4 which is utilized to defer the movement of the tempered workpieces toward the reheating furnace 8 disposed below conveyor 4.

Figure 2:
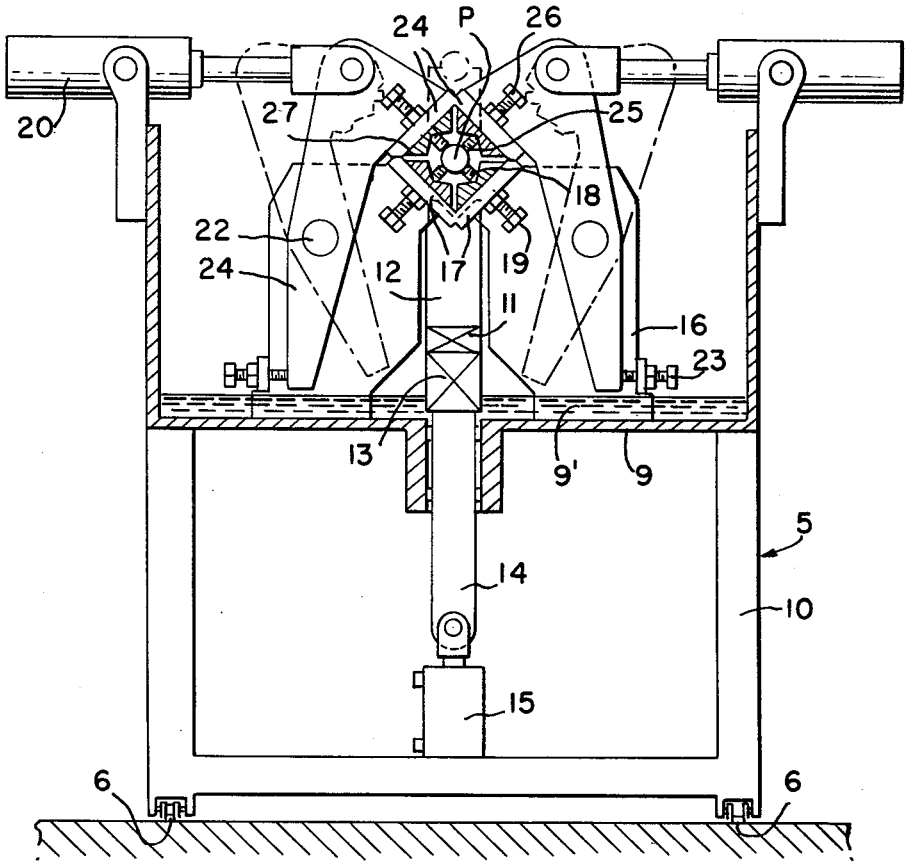
FIG. 2 is a vertical cross sectional view of the central tempering unit on the line A—A' of FIG. 1.
Figure 4:
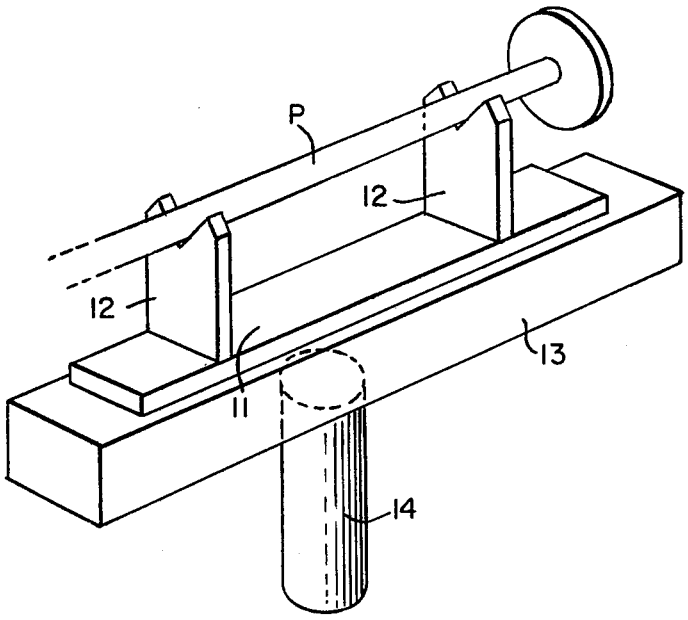
FIG. 4 is an enlarged detail of the traverse and support of FIG. 1 and FIG. 2.

The central tempering unit 5 shown in FIG. 2 includes a tempering bath 9 mounted on a support 10 movable on rail 6 as above discussed. The liquid level in bath 9 is seen at 9'. The central tempering unit 5 also comprises a horizontal traverse 11 acting on ejection supports 12. Traverse 11 is mounted on a second horizontal traverse 13 (FIG. 4) which is moved upwardly by the shaft 14 contolled by a jack 15, shaft 14 passing through a seal in the bottom of the tempering bath 9. The central tempering unit further includes a preadjusted and interchangeable tempering mount 16 resting on the bottom of the bath. Tempering mount 16 supports at least two metallic plates 17 in the form of a V. Lower support fingers 18 are adjustable in height by screws 19 with respect to the metallic plates. These lower supporting screws are disposed at about 45° with respect to a vertical plane and consequently are oriented in different planes to receive the workpiece P to be tempered. The tempering mount can include a certain number of bearing fingers disposed along the workpiece to be tempered as a function of its length. These bearing fingers include adjusting elements mounted on the preadjusted tempering mount. On each side of bath 9 and at its upper part are two closing screws 20 for the tempering mount each acting on a pivoting lever 21 articulated on horizontal axis 22 secured to the tempering mount and limited in closing by an adjustable stop 23 also fixed on the tempering mount. The levers 21 at the upper part carry metallic plates 24 inclined at a 45° angle which act as a support for the upper bearing fingers 25 which are adjustable in height by the screws 26 with respect to the metallic plates. In the positions shown in broken line, the pivoting levers 21 are open and allow for placing the workpiece P, utilizing a grappling mechanism not shown, on the lower support fingers 18. Then, the closing jacks 20 actuate the levers which take the position shown in solid line in which plates 24 cover piece P and the upper bearing fingers 25 engage the piece to secure it on its support. These bearing fingers constitute adjusting elements movable by the closing jacks of the tempering mount. Interchangeable elements 27 fit on plates 17 and 24 to limit the thickness of the layer of tempering liquid to an appropriate value.

Figure 3:
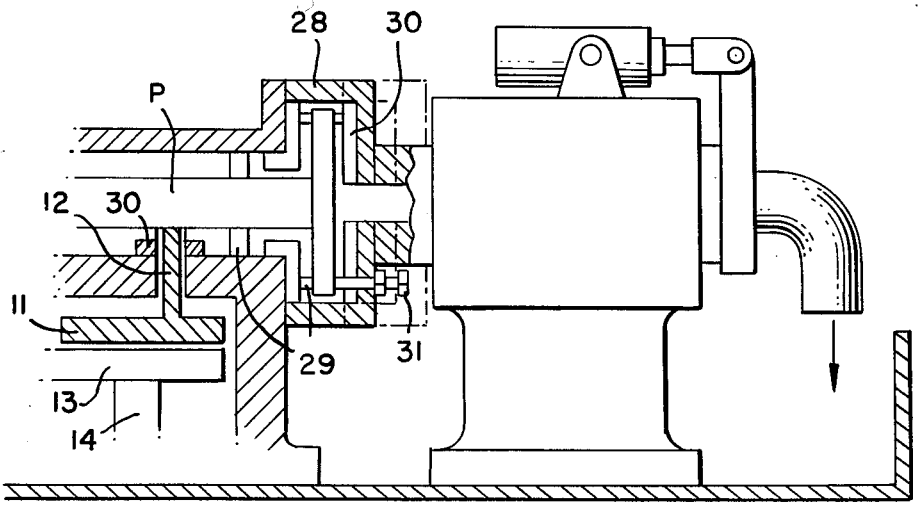
FIG. 3 is a view in a plane perpendicular to that of FIG. 2 in lateral elevation and partial section of the extremity of a central tempering unit.
Figure 5:
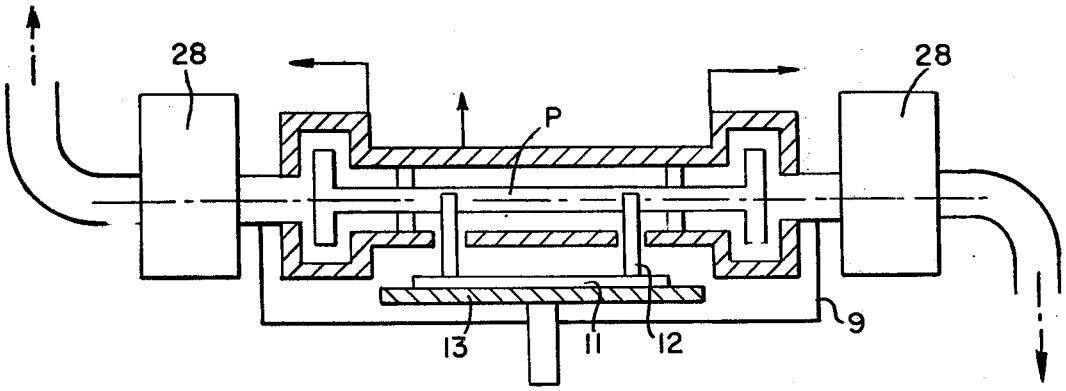
FIG. 5 is a schematic view of the flow of tempering fluid in the installation.

The central tempering unit, as is seen in FIG. 3, includes at each extremity movable closures 28 for supplying and removing tempering fluid (FIG. 5). These closures also include bearing fingers 29 for gripping the workpiece P and, as shown, workpiece P is a cam shaft. Interchangeable elements 30 fit the supports of these bearing fingers to limit the thickness of the layer of the tempering liquid to an appropriate value. The bearing fingers are provided with adjusting mechanism 31, only one of which has been shown for purposes of clarity in the figure.

The present invention is not limited to the preferred embodiment described above and may include all equivalent constructions.

What I claim is:

1. An installation for tempering in a thin layer shaped long cylindrical workpieces such as drive shafts and cam shafts for automobile engines including means for gripping workpieces in an austenization furnace, a center central tempering unit having a tempering tank and a transfer conveyor for the workpieces, the improvement comprising for said tempering unit a preadjusted and interchangeable support mechanism for the workpiece in said tank, a movable gripping system for the workpiece, pivoting levers carrying said system, closing jacks actuating said levers on opposite upper sides of said tempering tank, sealing means for limiting the thickness of the layer of tempering liquid applied to the workpiece to an appropriate value and means for feeding tempering liquid to said unit.

2. Installation as described in claim 1, said support mechanism of said tempering unit including a first horizontal traverse, ejection supports actuated by said horizontal traverse, a second horizontal traverse supporting said first horizontal traverse mounted in said bath and a jack connecting vertically for displacing said second traverse upwardly.

3. Installation as described in claim 1, said central tempering unit including movable closures at each end for supplying and removing tempering fluid.

4. Installation as described in claim 3, said movable closures including bearing fingers to grip the workpiece and interchangeable elements on supports for said fingers limiting the thickness of the layer of tempering liquid.

5. Installation as described in claim 1, said movable gripping system including upper bearing fingers mounted on pivoting levers, said upper bearing fingers being adjustable.

6. Installation as described in claim 1, said sealing means for limiting the thickness of the layer of tempering liquid to an appropriate value including interchangeable elements mounted on fixed and movable supports for bearing fingers for the piece to be treated.

* * * * *